US006648774B1

(12) United States Patent
Lee

(10) Patent No.: US 6,648,774 B1
(45) Date of Patent: Nov. 18, 2003

(54) COMPOSITE GOLF CLUB HEAD HAVING A METAL STRIKING INSERT WITHIN THE FRONT FACE WALL

(75) Inventor: Kyu Wang Lee, Danville, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/136,185

(22) Filed: May 1, 2002

(51) Int. Cl.[7] ..... A63B 53/04

(52) U.S. Cl. ..... 473/342; 473/345; 473/350; 473/329; 473/347

(58) Field of Search ..... 473/324, 342, 473/345, 350, 329, 346

(56) References Cited

U.S. PATENT DOCUMENTS

| | | | | |
|---|---|---|---|---|
| 4,193,601 A | | 3/1980 | Reid et al. | |
| 4,449,707 A | | 5/1984 | Hayashi et al. | |
| 4,883,275 A | | 11/1989 | Boone | |
| 5,207,428 A | | 5/1993 | Aizawa | |
| 5,242,168 A | | 9/1993 | Aizawa | |
| 5,288,070 A | | 2/1994 | Chen | |
| 5,328,176 A | | 7/1994 | Lo | |
| 5,342,812 A | | 8/1994 | Niskanen et al. | |
| 5,377,986 A | | 1/1995 | Viollaz et al. | |
| 5,445,382 A | | 8/1995 | Pearce et al. | |
| 5,547,427 A | | 8/1996 | Rigal et al. | |
| 5,624,331 A | | 4/1997 | Lo et al. | |
| 5,779,560 A | | 7/1998 | Buck et al. | |
| 6,050,904 A | * | 4/2000 | Kuo | 473/342 |
| 6,126,556 A | * | 10/2000 | Hsieh | 473/256 |
| 6,248,024 B1 | * | 6/2001 | Nelson et al. | 473/324 |
| 6,354,962 B1 | | 3/2002 | Galloway et al. | |
| 6,354,963 B1 | * | 3/2002 | Kodama et al. | 473/345 |
| 6,471,604 B2 | | 10/2002 | Hocknell et al. | |
| 6,491,592 B2 | | 12/2002 | Cackett et al. | |
| 2001/0049310 A1 | | 12/2001 | Cheng et al. | |
| 2002/0006836 A1 | | 1/2002 | Helmstetter et al. | |
| 2002/0142861 A1 | | 10/2002 | Helmstetter et al. | |

FOREIGN PATENT DOCUMENTS

| | | |
|---|---|---|
| GB | 1201648 | 8/1970 |

* cited by examiner

*Primary Examiner*—Paul T. Sewell
*Assistant Examiner*—Tom P Duong
(74) *Attorney, Agent, or Firm*—Michael A. Catania

(57) ABSTRACT

The present invention provides a hollow golf club head comprising a metal striking insert and a composite body. The metal striking insert (1) is molding within the front face wall (2) of the club head body and is securely attached at the outside perimeter of the insert to the composite body and at the front corners of the composite body through the use of a sandwiched structure (7,8, &9). The sandwich structure formed at the boundaries of the striking metal insert efficiently dissipates the impact energy affected when a golf ball is hit. The structure also dampens efficiently the vibrations of the shock affected when the ball is hit on the metal striking insert. The present invention of positioning the insert inside the face wall, not extending outside the face wall, uses less metal material which is heavier than the composite material and makes a larger club head at the same total weight of the club head. A larger golf club head that gives a higher moment of inertia is highly sought-after for a hollow club head construction.

5 Claims, 4 Drawing Sheets

COMPOSITE GOLF CLUB HEAD HAVING A METAL STRIKING INSERT WITHIN THE FRONT FACE WALL

BACKGROUND OF THE INVENTION

The present invention relates to a hollow golf club head.

Among the recent technology advancements for hollow driver-type golf club heads, two areas of technology advancement are noteworthy. The first is the size of the head, which became larger with a cavity design where the weight is located on the outer surfaces (outer perimeter) of the cavity. The moment of inertia of the golf club head is increased with this head geometry along with the presence of weights on the perimeter. For a golfer, an increased moment of inertia makes a golf shot which misses the sweet spot generally travel toward the intended target by countering slicing and hooking ball trajectories. Therefore, a shot that misses the "sweet spot" is more forgiving in terms of accuracy with a larger club head. The term sweet spot is well recognized by those skilled in the pertinent art.

The second technology advancement concerns the development of metal striking faces composed of titanium or steel. The metal striking face of a modern driver-type golf club head has been specifically constructed to achieve an efficient energy transfer from the metal striking face to the golf ball to achieve greater distance. A driver-type golf club head design based on a sweet spot with increased thickness, and a thinner region around the sweet spot has been accepted by club manufacturers as generating a higher C.O.R. (Coefficient Of Restitution). The C.O.R. is generally a measure of the ratio of the velocity out to velocity in. The United States Golf Association (USGA) regulates the C.O.R. using a test defined at www.usga.com, which involves a specific golf ball fired at a detached golf club head mounted on a pedestal.

The technology advancements to obtain maximum distance from a driver-type golf club head is well documented and widely advertised by many club manufacturers, such as Callaway Golf. In order to achieve longer distance from a driver, manufacturers have designed drivers with CORs at the limit of 0.83 in order to conform to the rule set forth by USGA in the USGA Procedure for Measuring the Velocity Ratio of a Club Head for Conformance to Rule 4-1e, Appendix II. Revision I, Aug. 4, 1998 and Revision 0, Jul. 6, 1998.

Some have recognized the problem and disclosed possible solutions.

An example of a large volume composite club head is Kodama et al., U.S. Pat. No. 6,354,963 for a golf club head. Kodama discloses a hollow golf club head made from a fiber reinforced epoxy resin that includes carbon fiber. It provides for a longer flight distance, a larger sweet spot and reduced veering in the flight path than a conventional golf club head.

Another example of a composite golf club head is Murphy et al., U.S. Pat. No. 6,248,025 for composite golf club head and method of manufacturing. The golf club head with a striking plate is composed of a composite material. The golf club head body is also composed of a composite material, and a weight strip is placed within a ribbon of the body.

Yet another example of a composite club head is Helmstetter et al., U.S. patent application Ser. No. 20020006836 for high moment of inertia composite golf club head. Helmstetter discloses golf club head of a high moment of inertia composed of a composite material and having a weight strip in a ribbon section.

The above prior art includes a composite club head with carbon fiber material including the striking face. The face composite plate is made relatively thick compared to the metal counterpart. Kodama et al., U.S. Pat. No. 6,354,963, discloses the face with a minimum thickness of 4 mm while Murphy et al., U.S. Pat. No. 6,248,025 discloses the striking plate having a thickness in the range of 0.110 inch (2.8 mm) to 0.155 inch (3.9 mm). A thicker plate is used with carbon fiber material because the composite has a relatively a low impact resistance and therefore a thin composite plate is not practically strong. However, a thicker composite becomes stiffer and the club face plate with a high thickness dimension does not deflect. On the other hand, the club head with a metal face with the thicker sweet spot with a thinner outer design deflects (and recovers) to give a higher C.O.R.

An example of a metal striking face is Lo, U.S. Pat. No. 5,328,176, for a composite golf head. Lo discloses a composite golf head having a front face of a metal reinforcing plate that has an upper extension fixed to a first part of the top portion. The metal reinforcing plate has a lower extension fixed to and wrapping around the bottom face and the rear face and extending to a second part of the top face.

Another example of a metal striking face is Cheng, et al., U.S. patent application Ser. No. 20010049310, for golf club head and a method for manufacturing the same. Cheng discloses a golf club head having a metal base, face and tubular neck and a carbon-fiber cover.

Yet, another example is Cackett and et al., U.S. patent application Ser. No. 20010055995, for a multiple material golf club head. Cackett discloses a golf club having a club head with a face component and an aft body. The face component, composed of a metal material, has a striking plate portion and a return portion. The aft-body is composed of a crown portion, a sole portion and optionally a ribbon section. The aft-body is composed of a non-metal material such as a composite material or a thermoplastic material.

The above prior art includes a composite club head with a metal face extended to the top and the bottom portion, U.S. Pat. No. 5,328,176, and a metal face that extends to the metal base, U.S. patent application Ser. No. 20010049310, and a metal face component having a return portion, U.S. patent application Ser. No. 20010055995.

SUMMARY OF THE INVENTION

The present invention provides a large volume composite golf club head having a metal striking insert molded within the front face wall of the club head body. One objective of the invention is accomplished by using a relatively smaller amount of metal material portion and a relatively larger amount of composite material to construct a golf club. The ratio of the composite material to the metal material is high.

One aspect of the present invention is the strength and durability of the attachment of the striking metal insert to the composite bead body by using a composite sandwiched structure. The edges of the striking metal insert extend outwardly and laterally to the general curvature of the outer surface of the golf club head. The edges of the striking metal insert are encapsulated by the composite layers to form the sandwich structure. This sandwich structure enables the present invention to dissipate the impact to the sandwiched structure and the rest of the composite body when the striking metal insert hits a golf ball.

The Present Invention is a larger volume club head with a higher moment of inertia. The moment of inertia of the golf club head is increased when the weight is located at the outer surface of the hollow club head. Heavier weight positioned farther from the center of gravity of the golf club head provides for a higher moment of inertia A larger volume club head that results from the present invention gives a higher moment of inertia. The moment of inertia is increased when the weight is located at the outer surface of the hollow club head. The farther and the heavier weight is, the higher the moment of inertia is.

Yet another aspect of the present invention is a golf club head that efficiently dampens the shock on the metal striking insert. The composite sandwiched structure, with the edges extending outwardly and laterally from the striking insert and located right behind the striking metal insert, dampens the shock during impact with a golf ball. Furthermore, encapsulating the edges with a large amount of carbon fiber composite dampens the shock in a unique and effective way. For an average golfer who sometimes misses the "sweet spot" of the golf club, the shock can produce an unpleasant feeling, and injure a golfer's elbow.

Yet another aspect of this invention is a golf club head having a metal striking insert with edges of the insert extending outwardly and laterally from the striking insert and having grooves and/or holes. These grooves or holes are filled with composite material during molding, and the bonding between the edges and the composite body is made stronger due to the filling of the grooves or holes with composite material.

In one preferred embodiment, the present invention provides a golf club head including a metal striking insert and a hollow club head body composed of a carbon fiber composite material. The hollow club head body includes a front face wall with an open portion within the perimeter of the front face wall. The metal striking insert is molded within at least a portion of the perimeter of the front face wall.

Other objects, features and advantages of the present invention will become apparent from the following detailed description when taken in conjunction with the accompanying drawings.

BRIEF DESCRIPTION OF THE DRAWINGS

The accompanying drawings, which are incorporated in and form a part of this specification, illustrate embodiments of the invention, where like numerals identify like components, and, together with the following detailed description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The present invention relates to a hollow golf club head, such as a driver and a fairway wood, that has a striking metal insert molded within the front face wall and the rest of the head body constructed with a light weight material such as carbon fiber composite.

More specifically the striking metal insert is positioned inside the face wall with the outer lateral edges of the metal insert strongly attached to the carbon fiber composite body in the shape of a carbon fiber sandwich structure. The striking plate is directly backed and supported by the composite sandwich structure which constitutes the front corners of the entire composite body to have an improved dissipation of the striking impact and hence a stronger and a more durable club head. The composite sandwich structure, behind the spiking plate, also efficiently dampens the vibration of the shock from the impact of striking a ball with the metal striking insert. Using less metal and more composite material in the construction of the club head allows for a larger club head which results in a higher moment of inertia.

The present invention provides a club head that is made by a strong bonding between the metal striking plate located inside the face wall and the composite body of which the front corners form a strong sandwiched structure with the outer edges of the metal insert which is extended laterally. In order to have a strong and durable club, the impact that occurs during the striking of a ball needs to be efficiently dissipated. The carbon fiber sandwiched structure itself and the structure that is connected to the rest of the composite club head dissipates it well.

The present invention provides a club head with a metal striking insert located inside the face wall and the insert plate is backed by a strong supportive carbon fiber sandwich structure. The sandwich structure, located right behind the hitting surface, is effective to dissipate the impact energy and to dampen the shock and the vibrations resulting from striking a ball with a metal plate.

Figure 1:
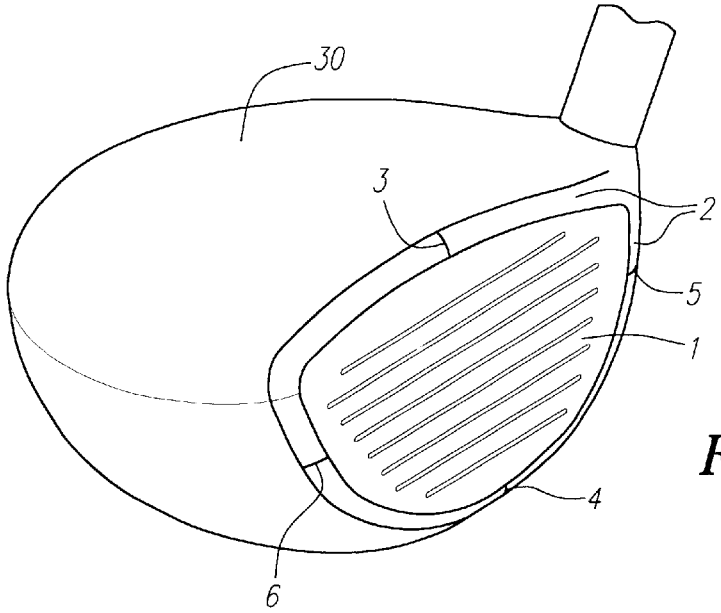
FIG. 1 is a front view of the golf club head of the present invention.

Referring now to the drawings, FIG. 1 illustrates the present invention where the metal striking insert (1) is placed inside the front face wall (2) while the rest of the club head body (30) except the insert is made of carbon fiber composite material. The insert (1) has the same general shape of the face wall (2) but smaller. The location of the insert is described as various distances in accordance to FIG. 1: 0 to 5 mm for (3) & (4) and 0 to 20 mm for (5) & (6), more preferably 0 to 3 mm for (3) & (4) and 0 to 10 mm for (5) & (6). The club head (30) typically could have dimensions of 300–600 cc.

Figure 2:
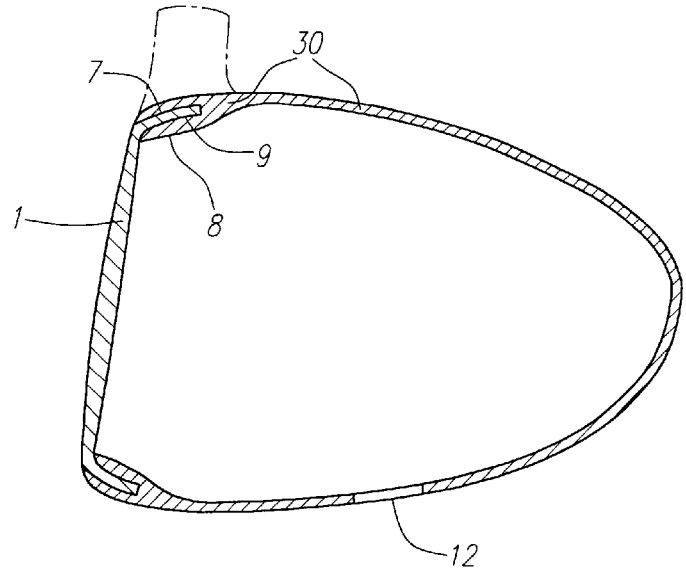
FIG. 2 is a side view of the golf club head of FIG. 1.

As shown in FIG. 2, the metal striking insert (1) that has the outer bonding edges (9) that extends outwardly and laterally to the curvature of the outer surface of the club head. The metal insert (1) can be made by casting, forging, hot isostatic pressing, machining, etc. More preferably, the metal insert (1) is a forged or cast metal made of titanium or stainless steel. The insert (1) can be other material such as metal matrix composite or ceramic material without departing from the scope and spirit of the present invention. The insert (1) is attached to the composite body (30) by a bonding process during the molding step, therefore, either a metallic or a non-metallic insert can be used.

Figure 5:
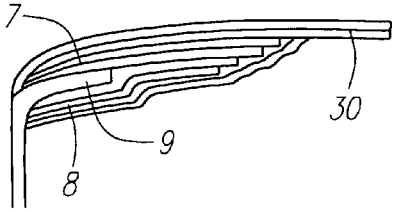
FIG. 5 is an exploded view and an isolated view the region A of FIG. 4.

Multiple layers of carbon fiber prepreg are used in the club head of the present invention. In FIG. 5, a five ply prepreg is depicted as one layer. Prepreg, resin pre-impregnated carbon fiber product which is commercially available from manufacturers such as Hexcel Corp. and Toray Corp., are laid up on the inside cavity of a mold. Carbon fiber prepreg is available with all of the carbon fibers oriented in one direction, Uni-directional prepreg, or with all of the carbon fibers woven, Bi-directional prepreg. The precise amount of resin is impregnated by the manufacturer while the content of the resin (RC,) varies from about 30 to 37% of the total prepreg weight. In a preferred embodiment, a RC of 31 to 34% is used in the golf club head. The resin matrix can be epoxy, polyester, polyimide, etc. Epoxy resin is used in a preferred embodiment. More preferably the resin is a toughened epoxy resin system available from Hexcel Corp. and Toray Corp. The toughened system has a higher impact resistance. The amount of the carbon fiber in the prepreg varies as well. 100 to 150 gram-material (gram per square meter) is mainly used in a preferred embodiment. There are a variety of carbon fibers with different strength and modulus properties. The carbon fiber used is composed of PAN ( polyacrylonitrile) precursor and has a tensile strength of 600 (4,000 Mpa) to 900 ksi (6,000 Mpa) and a tensile modulus of 40 (276 Mpa) to 60 msi (400 Mpa).

Figure 4:
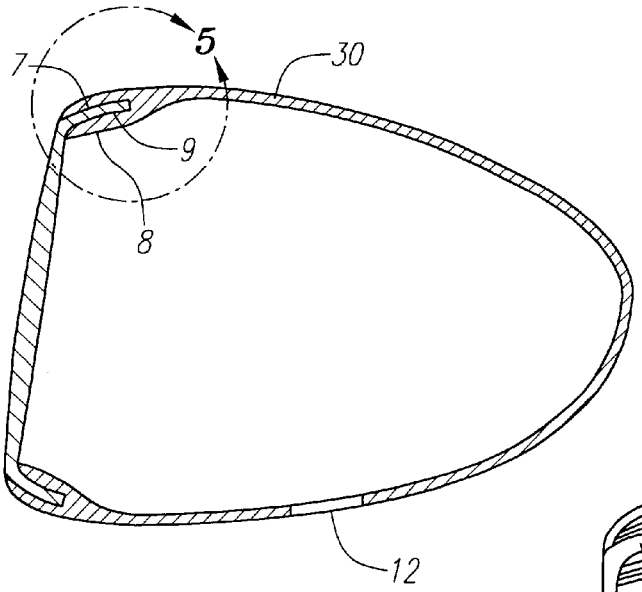
FIG. 4 is a side view of the golf club showing a sandwiched structure (A) with the edges of the insert.

As shown in FIGS. 2 & 4, some prepreg are placed on top of the metal edges (7) and some on the bottom side (8) forming a sandwich structure (A) with the metal edges (9) in the middle. The top layers (7) are laid up on the surface of the mold cavity. A clam-shelled mold made of either metal or composite is used.

Figure 2A:
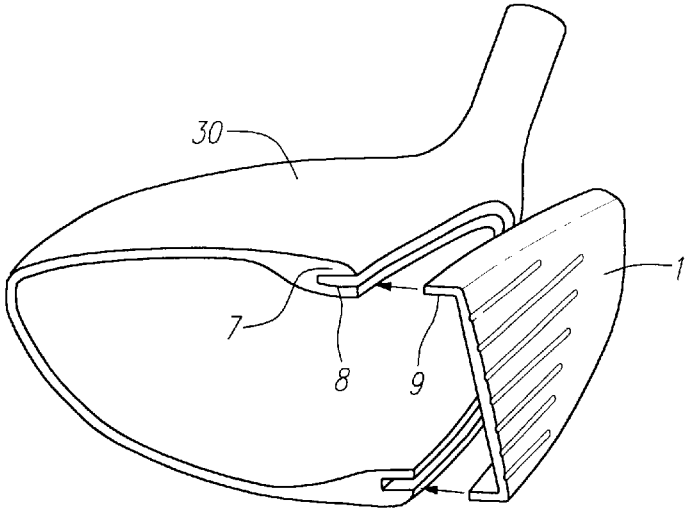
FIG. 2A is a three dimensional view of FIG. 2.

FIG. 2A is a three dimensional view of FIG. 2. It can be appreciated from FIG. 2A how the edge (9) of insert (1) can be molded within the edges (7, 8) of the hollow golf body (30) so as to form a sandwich structure (A) in accordance with the present invention.

Figure 3:
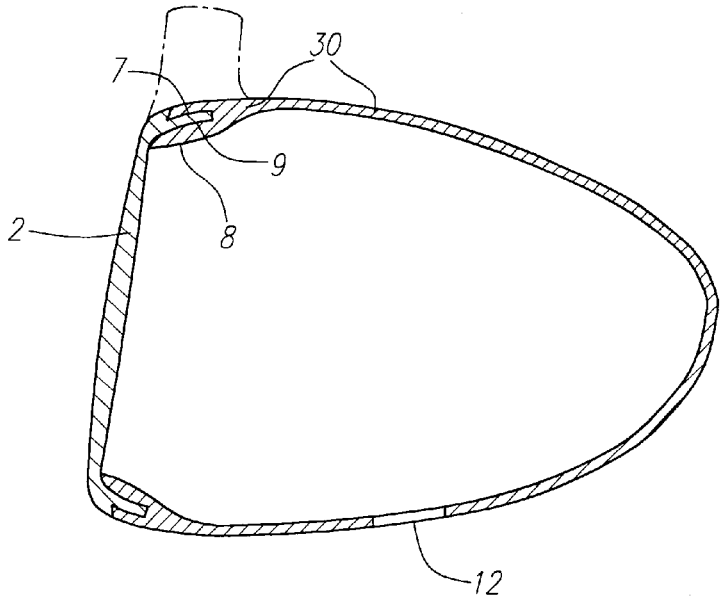
FIG. 3 is a side view of the golf club head with a maximum size of the insert.

FIG. 3. illustrates a situation when the metal insert (1) is larger and covers the face wall (2). The blown-up illustration of the sandwich lay-up (A) shown in FIG. 4. is shown in FIG. 5. Here, every layer consists of 5 plies of uni-directional prepreg superimposed. The areas such as the surface of the club head body (30) is laid-up using the bi-directional (fabric) prepreg. The sandwiched structure (A) is about 6 mm thick and has an extension about 20 mm long.

Figure 6:
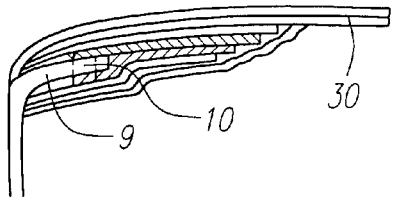
FIG. 6 is a modified version of the metal edges as shown on FIG. 5 showing an opening and/or a hole.

The metal edges (9) which form a sandwich structure, FIG. 5, can be modified to includes grooves, openings, or holes (11) as illustrated in FIG. 6. The modification gives a stronger bonding between the metal (1) and the composite body (30). A piece of prepreg is inserted into the hole, as described in FIG.7, and tied back to combine with the rest of the prepreg to form an integrated composite body (30). Some holes (11) are left unfilled. These holes (11), although they are left unfilled initially, will be filled during the later stage of curing step where an internal air pressure pushes the prepreg against the outer mold surfaces and the prepreg is heated and compacted. A strong attachment of the metal insert (1) to the composite body (30) prevents the insert (1) from falling apart from the club head body (30).

The strong bonding between the metal insert (1) and the composite body (30) is accomplished by the sandwich structure. The entire metal surfaces of the edges (7, 8) of the insert (9) is bonded while massive layers of carbon prepreg that form a sandwich structure is laminated to give a strong composite sub-structure. With this, an impact from a striking a ball with a metal insert (1) is dissipated and the shock from striking a ball with a metal insert is efficiently dampened. Composite material is a proven shock dampener.

After all the layers of prepreg are laid up, a plastic bag made of Nylon or latex rubber is placed on top of the prepreg inside the mold and it is exited from the mold cavity to a compressed air source through the mold opening (12) as illustrated in FIG. 4. About two layers of five plies of unidirectional prepreg is used for the club head except the sandwiched area around the bonding edges which takes much greater layers of prepreg. The prepreg is cured by applying heat, about 250 degrees Fahrenheit for 90 mins under the air pressure that is introduced into the bag. Typically about 100 psi of air pressure is used. The cure conditions described herein vary depending on the resin in the prepreg. The temperature can be lower and the heating time can be shorter depending on the specifications of the prepreg.

Figure 8:
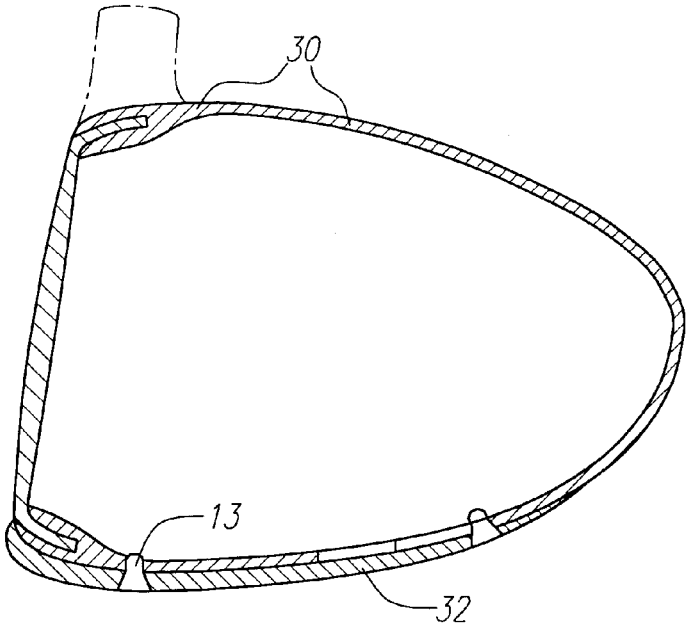
FIG. 8 is a side view of the golf club head showing a sole cover.

It is often desirable to protect the bottom of the club head because this area is subject to physical abuse during a swing. A protective outer cover (32) made of either plastic material such as Nylon or a metal plate such as aluminum, can be attached to the bottom. The cover (32) can be mechanically attached by using screws (13) or using an adhesive, as illustrated in FIG. 8. It is also desirable to have a detachable and an interchangeable cover so that a golfer can change the sole to make it heavier or lighter.

Figure 7:
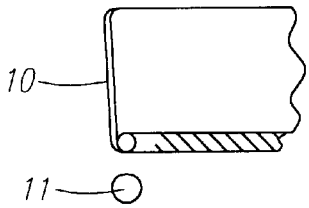
FIG. 7 is a top plan view of the golf club head of FIG. 6.
Figure 7A:
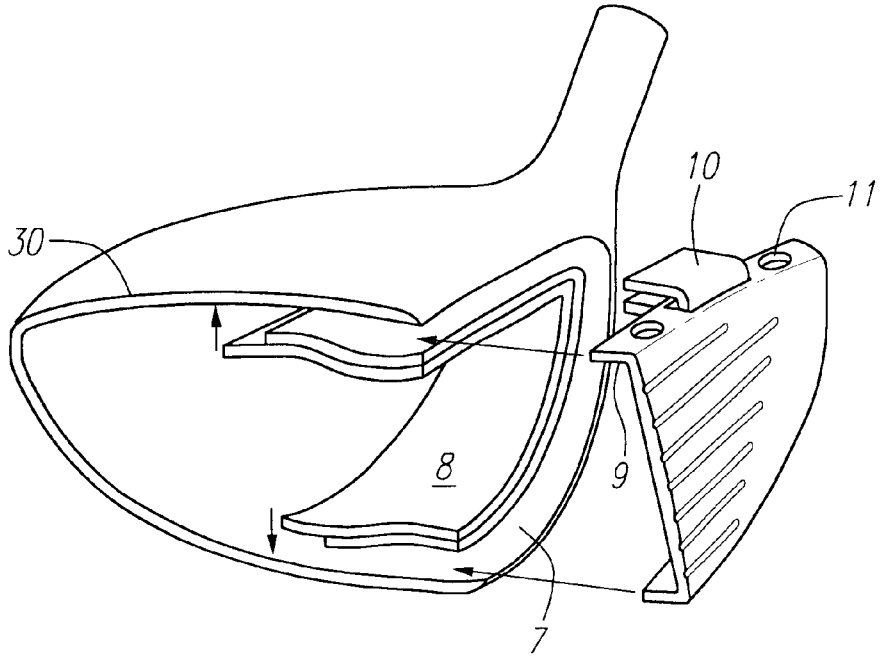
FIG. 7A is a three dimensional view of a golf club head of the present invention with the details as shown in FIG. 6.
Figure 7B:
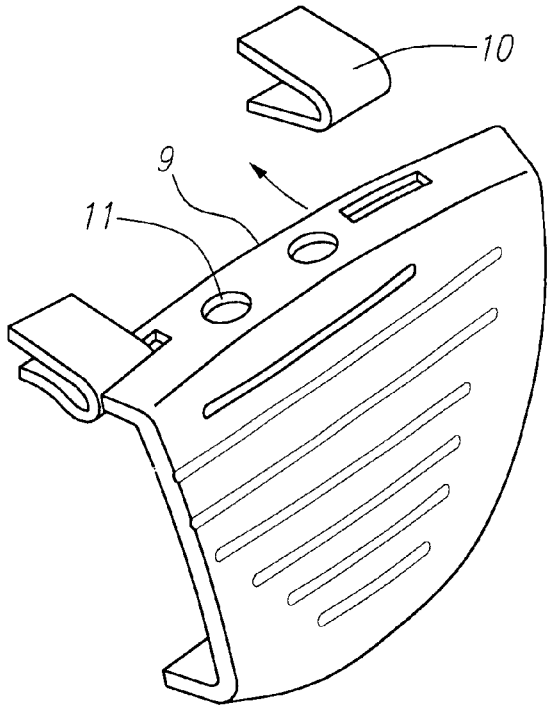
FIG. 7B is a three dimensional view of FIG. 7.

FIG. 7A is a three dimensional view of a golf club head of the present invention with the details as shown in FIG. 6 and FIG. 7B is a three dimensional view of FIG. 7. The desirable effect of the sandwich structure aspect can be appreciated, as shown in FIGS. 7A and 7B.

With the present invention of a large club head, a high moment of inertia is accomplished. The moment of inertia increases with a larger size cavity head and when the weight is located on the perimeter. Since the total weight of the club head made with a lighter material is low by the present invention, an extra weight can be placed on the perimeter to further increase the moment of inertia. The metal weight component is encapsulated between the layers of prepreg on the perimeter of the club head. This heavier weight component is sometimes called "back weight" or "perimeter weight" and it is well recognized by those skilled in the pertinent art. The weight component is either metal spheres or powders. The metal can be tungsten, lead, brass, steel, etc. In order to have a good bonding between metal weight component and prepreg, the metal weight component is coated with epoxy resin to wet the surfaces before it is used. Alternatively, prepreg which has a higher epoxy resin content can be used.

Figure 9:
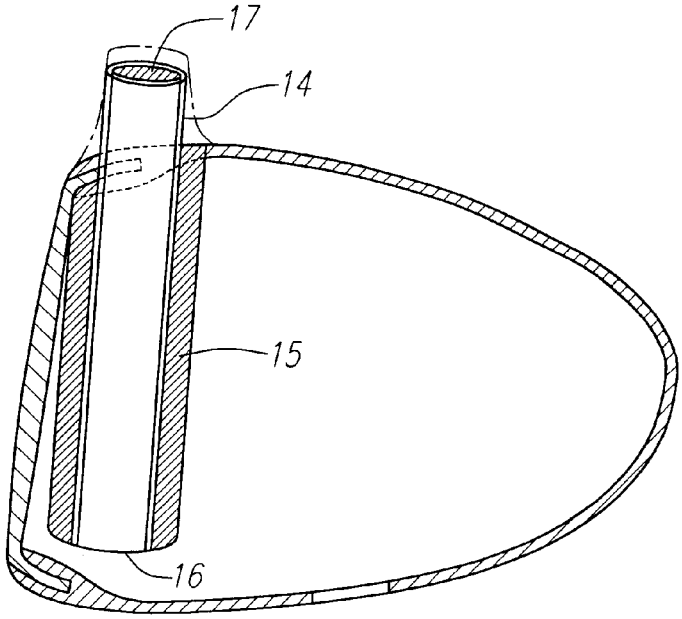
FIG. 9 is a side view of the golf club head showing an opening for the golf shaft installation.

The club head needs to accommodate an opening to get connected to the golf shaft. Typically, a metal opening of a tubular shape is welded to the metal face. Alternatively, to provide an opening made with carbon fiber, as shown in FIG. 9, an opening (15) is made using a mandrel. A pocket of carbon fiber prepreg (16) is molded together with the club head. Such pocket is made by wrapping a mandrel (17) with prepreg and removing the mandrel after the prepreg is cured. Between the mandrel and the prepreg layers, a heat conductive metal sleeve (14) can be included. The heat conductive sleeve is useful at a special occasion when you need to change the golf shaft that is already installed. The sleeve can be heated and the heat can be conducted to soften the bonding. Typically, the golf shaft is attached by bonding the tip portion of the shaft with an adhesive to the hosel. To take the shaft out, this portion is heated and the adhesive bonding becomes softened then the shaft is pulled out.

Nylon and Teflon are registered trade marks of Du Pont Company.

Hexcel is located in Dublin Calif., USA.

Toray America is located in Tacoma, Wash., USA.

Ping Golf is located in Phoenix, Ariz., USA.

Nike Golf is located in Beaverton, Oreg., USA.

Callaway Golf is located in Carlsbad, Calif., USA.

Taylormade Golf is located in Carlsbad, Calif., USA.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A golf club head comprising:

a metal striking insert with an edge extending laterally and outwardly from a striking plate; and a hollow club head body composed of plies of pre-preg material and having an open portion in a front wall, the hollow club head body having a first edge and a second edge, the metal striking insert attached to the front wall of the hollow club head body and covering the open portion of the front wall, wherein the edge of the metal striking insert is bonded by the first edge and the second edge of the hollow club head body to form a sandwich structure;

wherein the golf club head has volume ranging from 300 cubic centimeters to 600 cubic centimeters.

2. The golf club head according to claim 1 wherein the metal striking insert is composed of a material selected from the group consisting of titanium and stainless steel.

3. A golf club head comprising:

a metal striking insert with an edge extending laterally and outwardly from a striking plate, the edge having a plurality of openings; and a hollow club head body composed of plies of pre-preg material and having an open portion in a front wall, the hollow club head body having a first edge and a second edge, the metal striking insert attached to the front wall of the hollow club head body and covering the open portion of the front wall, wherein the edge of the metal striking insert is bonded by the first edge and the second edge of the hollow club head body to form a sandwich structure;

wherein the golf club head has volume ranging from 300 cubic centimeters to 600 cubic centimeters.

4. The golf club head according to claim 1 wherein a rear peripheral region of hollow club head body comprises metal powder composed of a powder selected from the group consisting of tungsten, brass and steel, and the metal powder disposed between the plies of pre-preg material.

5. A golf club head comprising:

a hollow club head composed of a carbon fiber composite material, the hollow club head body having a front face wall with an open portion, the hollow club head body having a first edge and a second edge; and a metal striking insert with an edge extending laterally and outwardly from a striking plate, the edge of the metal striking insert molded between the first edge and the second edge of the hollow club head body to form a sandwich structure;

wherein the golf club head has a volume ranging from 300 cubic centimeters to 600 cubic centimeters.

* * * * *